US005294526A

United States Patent [19]

Przezdziecki et al.

[11] Patent Number: 5,294,526

[45] Date of Patent: Mar. 15, 1994

[54] METHOD FOR THE MANUFACTURE OF A THERMALLY PROCESSABLE IMAGING ELEMENT

[75] Inventors: Wojciech M. Przezdziecki, Pittsford; Jean Z. DeRuyter, Spencerport, both of N.Y.

[73] Assignee: Eastman Kodak Company, Rochester, N.Y.

[21] Appl. No.: 20,911

[22] Filed: Feb. 22, 1993

[51] Int. Cl.[5] ..... G03C 1/04

[52] U.S. Cl. ..... 430/536; 430/619; 430/620

[58] Field of Search ..... 430/536, 619, 620

[56] References Cited

U.S. PATENT DOCUMENTS

| | | | |
|---|---|---|---|
| 4,741,992 | 5/1988 | Przezdziecki | 430/523 |
| 4,828,971 | 5/1989 | Przezdziecki | 430/531 |
| 4,857,439 | 8/1989 | Dedio et al. | 430/620 |
| 4,886,739 | 12/1989 | Przezdziecki | 430/617 |
| 4,942,115 | 7/1990 | Przezdziecki | 430/523 |

*Primary Examiner*—Janet C. Baxter

*Attorney, Agent, or Firm*—Alfred P. Lorenzo

[57] ABSTRACT

An improved method for manufacture of a thermographic or photothermographic element comprises the addition to the imaging composition of an amount sufficient to enhance the adhesive characteristics thereof of a polyalkoxysilane which has been pre-hydrolyzed in an organic solvent with a stoichiometric amount of water. A particularly suitable material is tetraethoxysilane which has been hydrolyzed in acetone with four moles of water for each mole of tetraethoxysilane.

16 Claims, No Drawings

METHOD FOR THE MANUFACTURE OF A THERMALLY PROCESSABLE IMAGING ELEMENT

CROSS-REFERENCE TO RELATED APPLICATIONS

Thermally processable imaging elements having a barrier layer interposed between the support and the image-forming layer are disclosed and claimed in copending commonly assigned U.S. patent application Ser. No. 020,912, filed Feb. 22, 1993, "Thermally Processable Imaging Element Comprising A Barrier Layer" by Wojciech M. Przezdziecki and Jean Z. DeRuyter.

FIELD OF THE INVENTION

This invention relates in general to imaging elements and in particular to the manufacture of thermally processable imaging elements. More specifically, this invention relates to an improved method for the manufacture of an imaging element comprising a thermographic or photothermographic layer which exhibits excellent adhesion characteristics.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, *Research Disclosure,* June 1978, Item No. 17029 and U.S. Pat. Nos. 3,080,254, 3,457,075 and 3,933,508.

An important feature of the aforesaid thermally processable imaging elements is a protective overcoat layer. To be fully acceptable, a protective overcoat layer for such imaging elements should: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the overcoat to a contiguous layer of the element, and (e) be free from cracking and undesired marking, such as abrasion marking, during manufacture, storage, and processing of the element.

A particularly preferred overcoat for thermally processable imaging elements is an overcoat comprising poly(silicic acid) as described in U.S. Pat. No. 4,741,992, issued May 3, 1988. Advantageously, water-soluble hydroxyl-containing monomers or polymers are incorporated in the overcoat layer together with the poly(silicic acid). The combination of poly(silicic acid) and a water-soluble hydroxyl-containing monomer or polymer that is compatible with the poly(silicic acid) is also useful in a backing layer on the side of the support opposite to the imaging layer as described in U.S. Pat. No. 4,828,971, issued May 9, 1989.

One of the most difficult problems involved in the manufacture of thermally processable imaging elements is that the protective overcoat layer typically does not exhibit adequate adhesion to the imaging layer. The problem of achieving adequate adhesion is particularly aggravated by the fact that the imaging layer is typically hydrophobic while the overcoat layer is typically hydrophilic. One solution to this problem is that described in U.S. Pat. No. 4,886,739, issued Dec. 12, 1989, in which a polyalkoxysilane is added to the thermographic or photothermographic imaging composition and is hydrolyzed in situ to form an $Si(OH)_4$ moiety which has the ability to crosslink with binders present in the imaging layer and the overcoat layer. Another solution to the problem is that described in U.S. Pat. No. 4,942,115, issued Jul. 17, 1990, in which an adhesion-promoting layer, in particular a layer composed of an adhesion-promoting terpolymer, is interposed between the imaging layer and the overcoat layer.

The known solutions to the problem of providing adequate overcoat adhesion with thermally processable elements exhibit certain disadvantages which have hindered their commercial utilization. For example, while incorporation of a polyalkoxysilane in the imaging composition brings about a gradual increase in adhesion on aging of the element, the in situ hydrolysis of the polyalkoxysilane is slow and its rate is limited by the availability of water in the coated layer. Moreover, the alcohol which is formed as a by-product of the hydrolysis, for example, the ethyl alcohol that is formed by hydrolysis of tetraethoxysilane, is unable to escape through the highly impermeable overcoat layer and tends to migrate into the support. The support is typically a polyester, most usually poly(ethylene terephthalate), and migration of the alcohol into such a support causes a highly undesirable width-wise curl which makes the imaging element very difficult to handle. A serious consequence of such width-wise curl, even though it may be very slight in extent, is jamming of processing equipment.

The problem of unwanted curl can be reduced by use of the adhesion-promoting interlayer of U.S. Pat. No. 4,942,115, but this approach can result in adverse sensitometric effects and requires an additional coating step which makes it economically less attractive.

Unwanted curl can also be reduced by use of a barrier layer which is comprised of poly(silicic acid) and a water-soluble hydroxyl-containing monomer or polymer that is compatible therewith and which is interposed between the support and the image-forming layer, as described in the aforesaid copending commonly assigned U.S. patent application Ser. No. 020,912, filed Feb. 22, 1993, "Thermally Processable Imaging Element Comprising A Barrier Layer" by Wojciech M. Przezdziecki and Jean Z. DeRuyter. However, this method also requires the use of an additional coating step.

It is toward the objective of providing an improved method for the manufacture of thermally processable imaging elements which does not require an additional coating step and which effectively avoids the problem of width-wise curl that the present invention is directed.

SUMMARY OF THE INVENTION

In accordance with this invention, a thermographic or photothermographic element is manufactured by an improved method comprising the steps of:

(1) preparing a thermographic or photothermographic imaging composition;

(2) hydrolyzing a polyalkoxysilane with a stoichiometric amount of water in an organic solvent;

(3) adding the product of step (2) to the thermographic or photothermographic imaging composition;

(4) applying to a support a layer of the product of step (3);

(5) drying the layer; and (6) overcoating the layer with a protective overcoat composition.

In the method of this invention, the organic solvent used in the hydrolysis step and the by-products of the hydrolysis step, such as alcohols, are removed in step (5) in which the imaging layer is dried. Since they are not present in the imaging layer when the overcoat is applied, they cannot migrate into the support to cause the curling problem that has been found to occur with the method of U.S. Pat. No. 4,886,739.

An organic solvent is utilized in the hydrolysis step employed in the method of this invention so as to render the product of the hydrolysis reaction compatible with the imaging composition, which itself typically contains one or more organic solvents. Water is utilized in a stoichiometric amount, i.e., one mole of water for each mole of alkoxy substituent in the polyalkoxysilane. Insufficient water to hydrolyze all of the alkoxy groups to alcohol is undesirable as in situ hydrolysis will then occur with the resulting disadvantage of generating alcohol that can migrate into the support. Excess water beyond that required for the hydrolysis reaction is also undesirable because it can result in a composition which when added to the thermographic or photothermographic imaging composition causes coagulation of an hydroxy-containing polymer.

The stoichiometric amount of water is dependent on the number of alkoxy substituents on the polyalkoxysilane. Thus, for example, with a tetraalkoxysilane like tetraethoxysilane, [$Si(OC_2H_5)_4$], the stoichiometric amount of water is four moles per mole of tetraethoxysilane. With a trialkoxysilane like phenyltriethoxysilane [$C_6H_5Si(OC_2H_5)_3$], the stoichiometric amount of water is three moles per mole of phenyltriethoxysilane.

DESCRIPTION OF THE PREFERRED EMBODIMENTS

The method of this invention is useful with any thermally processable element that is compatible with the hydrolyzed polyalkoxysilane that is added to the imaging composition. The thermally processable element can be a black-and-white imaging element or a dye-forming thermally processable imaging element. The polyalkoxysilane is particularly useful in a silver halide photothermographic element designed for dry physical development. Illustrative useful photothermographic elements include those described in, for example, U.S. Pat. Nos. 3,457,075; 4,459,350; 4,264,725; and 4,741,992 and *Research Disclosure,* June 1978, Item No. 17029. The hydrolyzed polyalkoxysilane is particularly useful in, for example, at least one imaging layer of a silver halide photothermographic element comprising a support bearing, in reactive association, in a binder, preferably a binder comprising hydroxyl groups, (a) photographic silver halide, prepared in situ and/or ex situ (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent.

Polyalkoxysilanes useful in the method of this invention include those represented by the formulae I or II as follows:

$$Si(OR_1)_4 \qquad \text{I}$$

$$R_2—Si(OR_3)_3 \qquad \text{II}$$

wherein $R_1$ and $R_3$ are individually unsubstituted or substituted alkyl containing 1 to 4 carbon atoms, such as methyl, ethyl, propyl and butyl, and $R_2$ is unsubstituted or substituted alkyl, such as alkyl containing 1 to 22 carbon atoms, such as methyl, ethyl, propyl, butyl, and n-octadecyl; or unsubstituted or substituted phenyl.

Specific examples of useful polyalkoxysilanes for the purpose of this invention include:

$Si(OC_2H_5)_4$ $Si(OCH_3)_4$ $C_6H_5Si(OC_2H_5)_3$ $C_6H_5Si(OCH_3)_3$ $NH_2CH_2CH_2CH_2Si(OC_2H_5)_3$ $NH_2CH_2CH_2CH_2Si(OCH_3)_3$

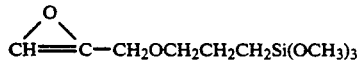

and $CH_3(CH_2)_{17}Si(OC_2H_5)_3$.

The thermally processable imaging element of this invention comprises at least one overcoat layer which is applied thereto at the time of manufacture of the element. The overcoat preferably comprises at least one polymer that contains hydroxyl groups that will react with the hydrolyzed polyalkoxysilane in the contiguous imaging layer. This enables increased adhesion between the imaging layer and the contiguous overcoat layer.

The optimum layer thickness of the imaging layer and any contiguous layer, such as an overcoat layer, depends upon various factors, such as the particular element, processing conditions, thermal processing means, desired image and the particular components of the layers. A particularly useful imaging layer thickness is typically within the range of 1 to 10 microns, preferably 3 to 7 microns. A particularly useful overcoat layer thickness is also typically within the range of 1 to 10 microns, preferably 1 to 3 microns.

Useful overcoat compositions are typically transparent and colorless. If the overcoat is not transparent and colorless, then it is necessary, if the element is a photothermographic element, that it be at least transparent to the wavelength of radiation employed to provide and view the image. The overcoat does not significantly adversely affect the imaging properties of the element, such as the sensitometric properties in the case of a photothermographic element, such as minimum density, maximum density, or photographic speed.

The overcoat composition preferably comprises 50 to 90% by weight of the overcoat of poly(silicic acid) and comprises a water-soluble hydroxyl-containing polymer or monomer that is compatible with the poly(silicic acid). Such an overcoat composition is described in, for example, U.S. Pat. No. 4,741,992. Examples of water soluble hydroxyl-containing polymers are acrylamide polymers, water-soluble cellulose derivatives, hydroxy ethyl cellulose, water-soluble cellulose acetate, and poly(vinyl alcohol). Partially hydrolyzed poly(vinyl alcohols) are preferred.

Thermally processable imaging elements as described can contain multiple polymer-containing layers, such as multiple overcoat layers. For example, the thermally processable imaging element can contain a first overcoat layer comprising a polymer other than poly(silicic acid), such as a cellulose derivative, and a second overcoat layer comprising poly(silicic acid) and poly(vinyl alcohol).

A preferred overcoat comprises 50 to 90% by weight of poly(silicic acid) represented by the formula:

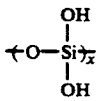

wherein x is an integer within the range of at least 3 to about 600 and wherein the overcoat also comprises 10 to 50% poly(vinyl alcohol).

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure,* December 1978, Item No. 17029 and *Research Disclosure,* June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure,* June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,381. Examples of useful sulfonamidophenol reducing agents are 2,6-dichloro-4-benzene-sulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt oxidizing agent, and the particular polyalkoxysilane.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure,* June 1978, Item No. 17029 and U.S. Pat. No. 4,123,282. Examples of useful toning agents include, for example phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermo-graphic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure,* December 1978, Item No. 17643 and *Research Disclosure,* June 1978, Item No. 17029.

The thermally processable element can comprise a variety of supports. Examples of useful supports are poly(vinylacetal) film, polystyrene film, poly(ethyleneterephthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure,* June 1978, Item No. 17029 and *Research Disclosure,* December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo--p-tolysulfonylacetamide; 2-(tribromomethyl sulfonyl)-benzothiazole; and 6-substituted-2,4-bis(tribromomethyl)-s-triazines, such as 6-methyl or 6-phenyl-2,4-bis(-tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 130° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

As hereinabove described, the improved method of this invention comprises the steps of:

(1) preparing a thermographic or photothermographic imaging composition;

(2) hydrolyzing a polyalkoxysilane with a stoichiometric amount of water in an organic solvent;

(3) adding the product of step (2) to the thermographic or photothermographic imaging composition;

(4) applying to a support a layer of the product of step (3);

(5) drying the layer; and (6) overcoating the layer with a protective overcoat composition.

Step (1) of the method is carried out in accordance with conventional practice as described hereinabove.

Hydrolysis of the polyalkoxysilane in step (2) can be carried out in any suitable reaction vessel such as, for example, vessels composed of glass or stainless steel. Time and temperature conditions for carrying out the hydrolysis are typically 2 to 6 hours at room temperature. Any water-miscible organic solvent can be utilized in this step which will be compatible with the imaging composition. Examples of preferred organic solvents include ketones, alcohols, esters, ethers, glycols and glycol ethers. Particularly preferred organic solvents are the ketones and especially acetone and 4-methyl-2-pentanone.

It is particularly preferred in the method of this invention to utilize an organic solvent having a boiling point at atmospheric pressure in the range of from 50° C. to 150° C.

To promote the hydrolysis reaction, it is especially useful to employ a catalyst which increases the rate of reaction. Useful catalysts for this purpose include mineral acids such as hydrochloric acid or sulfuric acid and organic acids such as p-toluene sulfonic acid, camphor sulfonic acid, trifluoroacetic acid, palmitic acid, and mixtures thereof.

Factors affecting the hydrolysis reaction include the particular organic radical of the alkoxy group, the solvent, the catalyst, the temperature and the concentration.

The hydrolyzed polyalkoxysilane is added to the imaging composition in step (3) in any amount which is sufficient to improve adhesion between the imaging layer and a contiguous layer. The amount of hydrolyzed polyalkoxysilane added is typically in the range of from about 1 to about 25 percent by weight, based on total imaging composition, and more preferably in the range of from about 5 to about 15 percent by weight.

Steps (4), (5), and (6) in the method of this invention are carried out in accordance with conventional practice in this art. Times and temperatures suitable for the drying step are 1 to 10 minutes at 60° to 80° C. Use of such drying conditions ensures that substantially all of the organic solvent and by-products of the hydrolysis reaction are driven from the imaging layer before the overcoat is applied.

The invention is further illustrated by the following examples of its practice.

In the following examples, tetraethoxysilane is referred to as "TEOS" and tetraethoxysilane which has been hydrolyzed with a stoichiometric amount of water in an organic solvent is referred to as "pre-hydrolyzed TEOS".

EXAMPLE 1

A photothermographic composition was coated on a poly(ethylene terepthalate) support and dried to form a photothermographic layer of the following composition:

| Component | g/m² |
|---|---|
| Silver behenate | 0.861 |
| $HgBr_2$ | 0.001 |
| AgBr | 0.43 |
| NaI | 0.038 |
| Succinimide | 0.452 |
| *Surfactant | 0.02 |
| 2-Bromo-2-p-tolylsulfonyl acetamide | 0.065 |
| 2,4-Bis(trichloromethyl)-6-(1-naphtho)-S-triazine | 0.065 |
| **Binder | 4.30 |
| Sensitizing dye | 0.005 |
| 4-Benzenesulfonamidophenol | 1.07 |
| Pre-hydrolyzed TEOS | As indicated below |

*A polysiloxane fluid available under the trademark SF-96 from General Electric Company

**A poly(vinyl butyral) available under the trademark BUTVAR B-76 resin from Monsanto Company The pre-hydrolyzed TEOS composition utilized was as follows:

| | |
|---|---|
| Distilled water | 72.0 g (4 moles) |
| P-toluene sulfonic acid | 1.4 g |
| Acetone | 200.0 g |
| TEOS | 208.0 g (1 mole) |

The photothermographic layer was provided with a protective overcoat layer of the following composition:

| | |
|---|---|
| ***ELVANOL 52/22 resin | 1.07 g/m² |
| Poly(silicic acid) | 1.35 g/m² |
| Methylmethacrylate beads | 0.054 g/m² |

***ELVANOL 52/22 is a trademark for a poly(vinyl alcohol) resin available from E. I. duPont deNemours Company To evaluate the effect of adding pre-hydrolyzed TEOS to the photothermographic composition, test samples were prepared in which the content of pre-hydrolyzed TEOS was as indicated in Table I below. Each sample was exposed and processed and then evaluated in an adhesion test using test tapes $T_1$, $T_2$ and $T_3$ as follows:

| Tape* | Bonding Strength (g/1.9 cm) |
|---|---|
| $T_1$ - SCOTCH Magic Tape #811 | 25 |
| $T_2$ - SCOTCH Magic Tape #810 | 250 |
| $T_3$ - HIGHLAND 3M 5910 Transparent Tape | 450 |

*These tapes are sold by Minnesota Mining and Manufacturing Company

In the adhesion test, the tape was laminated to the sample and then pulled off at an angle of approximately 180 degrees. The surface was examined and rated in accordance with the following ratings:

S—stripping

PS—partial stripping

NS—no stripping

In Table I below, a concentration level of pre-hydrolyzed TEOS of 1.00 is equivalent to 2 g/m² of TEOS.

TABLE I

| Test No. | Concentration of Pre-hydrolyzed TEOS | Adhesion Test $T_1$ | $T_2$ | $T_3$ |
|---|---|---|---|---|
| 1 | 0 | NS | S | S |
| 2 | 0.25 | NS | NS | S |
| 3 | 0.50 | wNS | NS | NS |
| 4 | 0.75 | NS | NS | NS |
| 5 | 1.00 | NS | NS | NS |

As indicated by the data in Table I, addition of a sufficient amount of the pre-hydrolyzed TEOS provides excellent adhesion between the overcoat layer and the photothermographic layer. Thus, for example no stripping occurred even with the tape with the highest bonding strength at pre-hydrolyzed TEOS levels of 0.50 or greater. Moreover, the photothermographic element was free of any tendency to exhibit excessive width-wise curl that would cause jamming of processing equipment.

EXAMPLE 2

Example 1 was repeated except that palmitic acid was added to the pre-hydrolyzed TEOS composition in an amount sufficient to provide 0.25 g/m$^2$ of palmitic acid in the photothermographic layer and the adhesion test was applied to raw stock rather than exposed and processed material. As disclosed in Dedio et al, U.S. Pat. No. 4,857,439, issued Aug. 15, 1989, palmitic acid and similar carboxylic acids can be incorporated in photothermographic elements for the purpose of improving latent image stability. The results obtained are summarized in Table II below:

TABLE II

| Test No. | Concentration of Pre-hydrolyzed TEOS | Adhesion Test $T_1$ | $T_2$ | $T_3$ |
|---|---|---|---|---|
| 6 | 0 | S | S | S |
| 7 | 0.25 | PS | S | S |
| 8 | 0.50 | NS | NS | NS |
| 9 | 0.75 | NS | NS | NS |

As indicated by the data in Table II, addition of a sufficient amount of the pre-hydrolyzed TEOS composition provided greatly improved adhesion with raw stock material. Moreover, the raw stock exhibited no tendency to undergo excessive width-wise curl.

As shown by the above examples, the improved method of this invention provides excellent adhesion without causing unwanted width-wise curl. This is achieved by the technique of pre-hydrolyzing the polyalkoxysilane before it is combined with the imaging composition so that by-products that are generated by in situ hydrolysis are avoided. No additional coating steps are required in the method of this invention, unlike that of U.S. Pat. No. 4,942,115, so that the improved method is more economically attractive.

The invention has been described in detail, with particular reference to certain preferred embodiments thereof, but it should be understood that variations and modifications can be effected within the spirit and scope of the invention.

We claim:

1. A method for the manufacture of a thermographic or photothermographic element, said method comprising the steps of:
   (1) preparing a thermographic or photothermographic imaging composition;
   (2) hydrolyzing a polyalkoxysilane with a stoichiometric amount of water in an organic solvent,
   (3) adding the product of step (2) to said thermographic or photothermographic imaging composition;
   (4) applying to a support a layer of the product of step (3);
   (5) drying said layer; and
   (6) overcoating said layer with a protective overcoat composition.

2. A method as claimed in claim 1 wherein said imaging composition comprises:
   (a) photographic silver halide,
   (b) an image-forming combination comprising
      (i) an organic silver salt oxidizing agent, with
      (ii) a reducing agent for the organic silver salt oxidizing agent, and
   (c) a toning agent.

3. A method as claimed in claim 1 wherein said polyalkoxysilane is represented by formula I or II as follows:

$$Si(OR_1)_4 \qquad \text{I}$$

$$R_2—Si(OR_3)_3 \qquad \text{II}$$

wherein $R_1$ and $R_3$ are individually unsubstituted or substituted alkyl containing 1 to 4 carbon atoms and $R_2$ is unsubstituted or substituted alkyl or phenyl.

4. A method as claimed in claim 1 wherein said polyalkoxysilane is
$Si(OC_2H_5)_4$
$Si(OCH_3)_4$
$C_6H_5Si(OC_2H_5)_3$
$C_6H_5Si(OCH_3)_3$
$NH_2CH_2CH_2CH_2Si(OC_2H_5)_3$
$NH_2CH_2CH_2CH_2Si(OCH_3)_3$

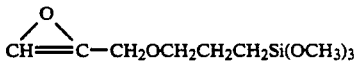

or
$CH_3(CH_2)_{17}Si(OC_2H_5)_3$.

5. A method as claimed in claim 1 wherein said organic solvent is acetone.

6. A method as claimed in claim 1 wherein said hydrolyzed polyalkoxysilane is added in step (3) in an amount of from about 1 to about 25 percent by weight of said imaging composition.

7. A method as claimed in claim 1 wherein said support is a poly(ethylene terephthalate) film.

8. A method as claimed in claim 1 wherein said imaging composition is a hydrophobic composition and said protective overcoat composition is a hydrophilic composition.

9. A method as claimed in claim 1 wherein said protective overcoat composition comprises poly(silicic acid).

10. A method as claimed in claim 1 wherein said protective overcoat composition comprises poly(silicic acid) and a water-soluble hydroxyl-containing monomer or polymer.

11. A method as claimed in claim 1 wherein said protective overcoat composition comprises poly(vinyl alcohol) and poly(silicic acid) formula:

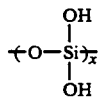

wherein x is an integer within the range of at least 3 to about 600.

12. A method as claimed in claim 1 wherein said imaging composition comprises a poly(vinyl butyral) binder.

13. A method as claimed in claim 1 wherein said imaging composition comprises:
   (a) photographic silver halide,
   (b) an image-forming combination comprising (i) silver behenate, with (ii) a phenolic reducing agent for the silver behenate, (c) a succinimide toning agent, and (d) an image stabilizer.

14. A thermographic or photothermographic element produced by the method of claim 1.

15. A method for the manufacture of a photothermographic element, said method comprising the steps of:

(1) preparing a photothermographic imaging composition comprising:

(a) photographic silver halide, and (b) an image-forming combination comprising (i) an organic silver salt oxidizing agent, with (ii) a reducing agent for said organic silver salt oxidizing agent;

(2) hydrolyzing tetraethoxysilane in acetone with four moles of water;

(3) adding the hydrolyzed tetraethoxysilane formed in step (2) to said imaging composition in an amount of about 5 to about 15 percent by weight;

(4) applying to a poly(ethylene terephthalate) film support a layer of the product of step (3);

(5) drying said layer; and (6) overcoating said layer with a protective overcoat composition comprising poly(silicic acid) and poly(vinyl alcohol).

16. A photothermographic element produced by the method of claim 15.

* * * * *